United States Patent [19]

Spinner et al.

[11] Patent Number: 4,880,949

[45] Date of Patent: Nov. 14, 1989

[54] SWITCH DRIVE FOR A ROTARY SWITCH

[75] Inventors: Georg Spinner, Feldkirchen-Westerham; Franz-Xaver Pitschi, Rottach-Egern; Horst Linnerbauer, Bruckmühl, all of Fed. Rep. of Germany

[73] Assignee: Spinner GmbH, Elektrotechnische Fabrik, Munich, Fed. Rep. of Germany

[21] Appl. No.: 173,168

[22] Filed: Mar. 24, 1988

[30] Foreign Application Priority Data

Mar. 27, 1987 [DE] Fed. Rep. of Germany ..... 3710149

[51] Int. Cl.[4] ..... H01H 3/42

[52] U.S. Cl. ..... 200/501; 335/288

[58] Field of Search ..... 200/153 P, 153 LB, 501; 335/74, 75, 288

[56] References Cited

U.S. PATENT DOCUMENTS

| | | | |
|---|---|---|---|
| 2,718,567 | 9/1955 | Elliot et al. | 335/75 |
| 2,753,406 | 7/1956 | Pigman | 200/153 P |
| 3,423,555 | 1/1969 | Preux | 200/153 P |
| 3,675,170 | 7/1972 | Wellman, Jr. | 335/288 X |
| 4,717,799 | 1/1988 | Spinner | 200/153 P |

*Primary Examiner*—Renee S. Luebke

*Attorney, Agent, or Firm*—Henry M. Feiereisen

[57] ABSTRACT

A switch drive for a rotary switch includes a driven shaft at its input and a switch drive shaft at its output. The input shaft supports a lever for transmitting the movement of the input shaft to a pinion fixedly connected to the lever. The pinion rolls along an internal toothing and supports an engaging member which is in slidable engagement with a switch arm connected to the switch drive shaft.

8 Claims, 5 Drawing Sheets

B
A 2
1
7
6
9a
5
11
4
8a
8
10
M
3a
3
4a
9
1a
11a
12

A
B
1
2
3
3a
4
4a
5
6
7
8
8a
9
9a
10
11
12
31
32
33

SWITCH DRIVE FOR A ROTARY SWITCH

BACKGROUND OF THE INVENTION

The present invention refers to a switch drive for a rotary switch, especially to a switch drive with a switching angle of 90°.

A switch drive of the concerned type is known from the U.S. Pat. No. 4,717,799 which includes an input shaft driven by an electromotor and supporting an intermediate part in the form of a gear. The gear meshes with a pinion which carries an eccentric engaging member projecting into a groove of a switch arm to rotate the latter about a switching angle of 90°. The switch arm is fixedly connected to a switch drive shaft to transmit the switching movement thereto. Since the engaging member describes a hypocycloid, a switch drive of this type attains a high switching speed with smooth initiation and smooth termination of the switching action, and simultaneously accomplishes a precise positioning of the switch arm in both its end positions without requiring additional stop members.

Such a switch drive is, however, rather complicated to manufacture and is of considerable dimensions especially when high torques are desired because it requires an electromotor and an additional slipping clutch associated to the latter.

SUMMARY OF THE INVENTION

It is thus an object of the present invention to create an improved switch drive for a rotary switch obviating the afore-stated drawbacks.

This object and others which will become apparent hereinafter are attained in accordance with the present invention by providing a lever as an intermediate member which is fixedly connected to the input shaft and supports the pinion.

Preferably, the pinion is supported on a bearing bolt which is fixedly connected to the lever.

Through the provision of a lever connecting the input shaft with the pinion, the structure is considerably simplified as the use of a gear supported by the input shaft and the use of a toothed gearing becomes unnecessary. Therefore, the required rotatable bearing plate for supporting the pinion as employed in the conventional switch drive shaft is omitted as the pinion is directly supported by the lever.

According to a further feature of the present invention, the lever can be provided with at least one cam which actuates an auxiliary contact in each of its end positions, thus omitting the use of additional pinions as employed in the known switch drive.

The rotational angle of the lever corresponds to the switching angle as executed by the switch arm. Especially when using switch drives with a switching angle of 90°, the use of a rotary magnet as electromotive drive is suitable. Such rotary magnets are available in various forms and deliver a rotational movement with constant torque. The switch arm reciprocates during switching thereof.

At different rotational angles and/or switches without reversal of the rotational direction of the switch arm (and thus of the switch shaft connected therewith), the drive may be modified and may include according to another embodiment of the present invention a worm wheel which is fixedly connected to the input shaft and meshes with an electromotively driven worm. The provision of such a drive allows a very compact and small switch drive even at high torques. This is especially true when accommodating the worm and the worm wheel in the space between the lever and the switch arm.

BRIEF DESCRIPTION OF THE DRAWING

The above objects, features and advantages of the present invention will now be described in more detail with reference to the accompanying drawing in which.

DETAILED DESCRIPTION OF PREFERRED EMBODIMENTS

Figure 1:
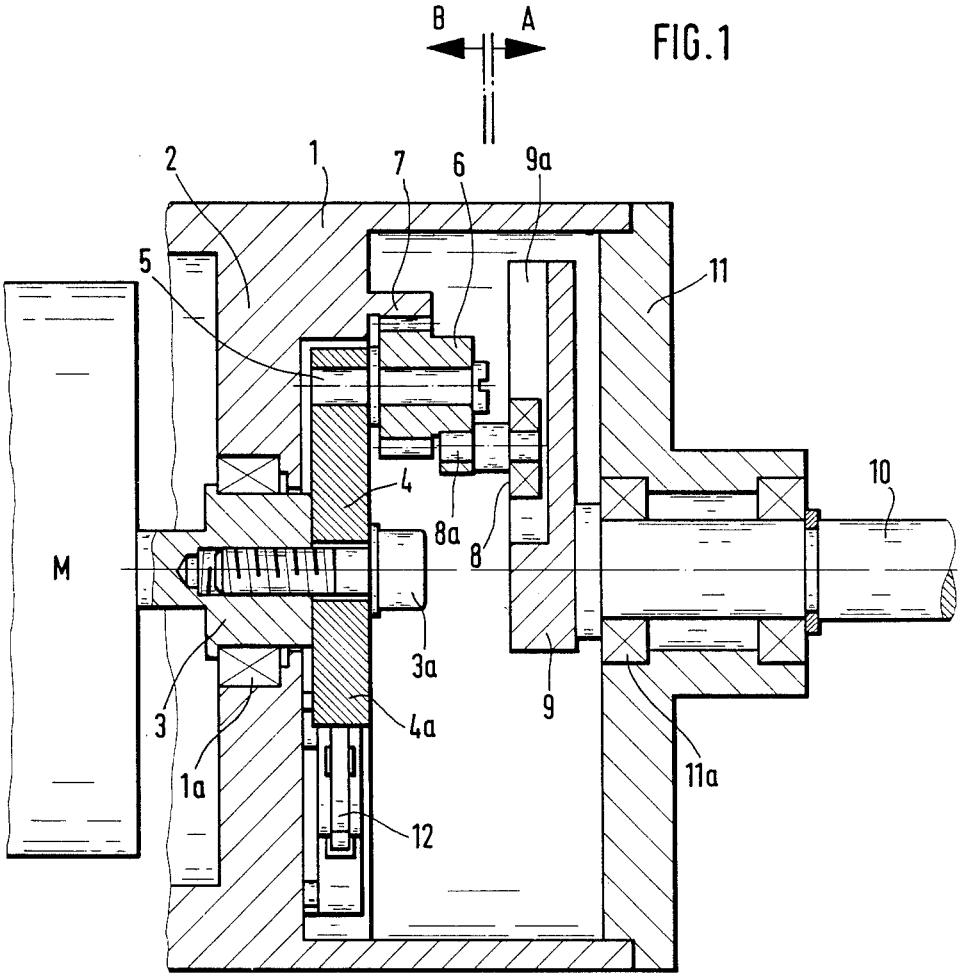
FIG. 1 is a schematically simplified longitudinal section of one embodiment of a switch drive according to the invention taken along the line I—I in FIG. 3.

Referring firstly to FIG. 1, there is shown a schematically simplified cross sectional view of one embodiment of a switch drive in accordance with the present invention. The switch drive has an essentially cylindrical casing 1 with one end face 2 supporting an input shaft 3 which is supported by suitably bearings as indicated at 1*a.* The input shaft 3 is driven by a rotary magnet M which is illustrated only schematically in FIG. 1 and provides a rotational movement with approximately constant torque.

At its inward end remote from the rotary magnet M, the shaft 3 is provided with a blind bore in which a screw 3*a* is inserted or threadably engaged to retain a lever 4 in non-rotational manner on the shaft 3. The lever 4 is provided at its upper end with a bearing bolt 5 for supporting a rotatable pinion 6 meshing with an internal toothing 7 integrally connected to the casing 1. The internal toothing 7 extends concentrically to the shaft 3 at least about an arc corresponding to the provided switching angle.

The pinion 6 carries an eccentric bearing bolt 8*a* for supporting an engaging member 8 in the form of a roller. The engaging member 8 projects in a groove 9*a* of a facing switch arm 9 which is connected non-rotationally to a switch drive shaft 10. The switch drive shaft 10 extends coaxial with the input shaft 3 and is rotatably supported in a lid 11 of the casing 1 by suitable bearings 11*a.*

Figure 3:
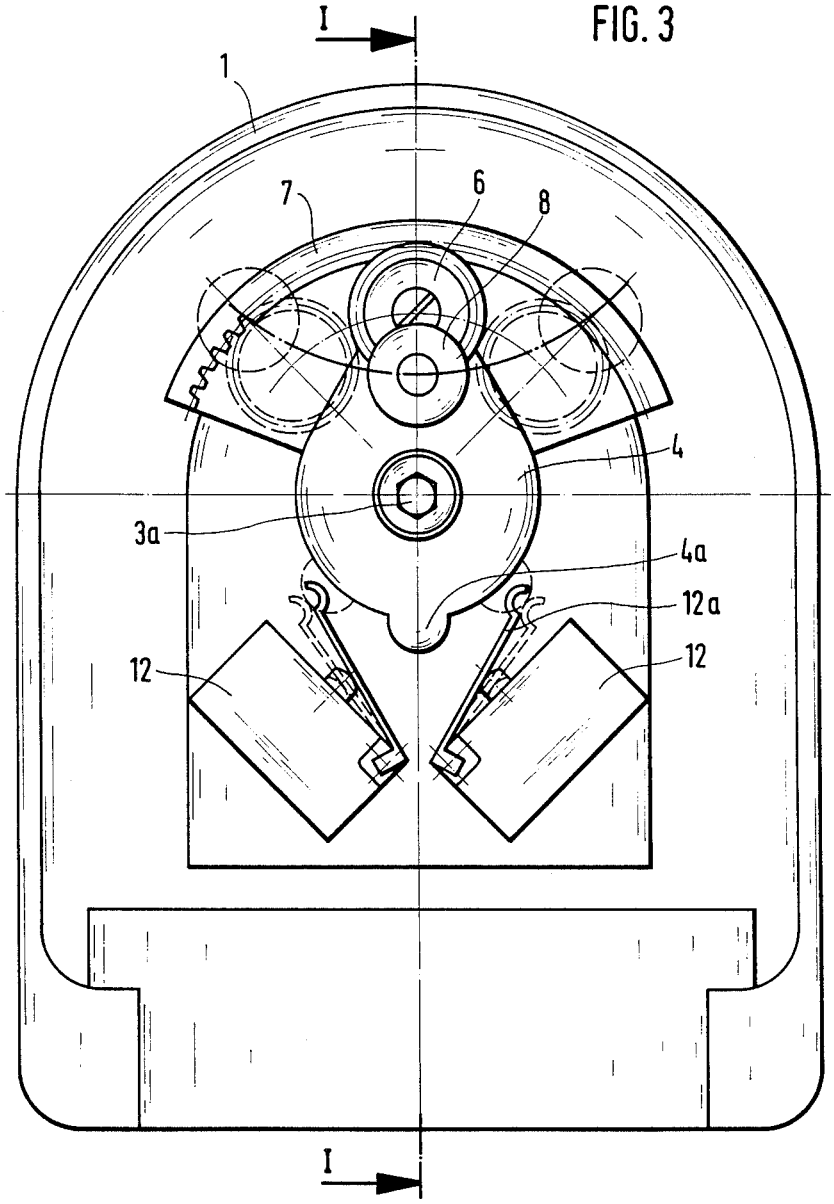
FIG. 3 is a partial view of the switch drive according to FIGS. 1 and 1*a* in accordance with arrow B in FIGS. 1 and 1*a.*

At its end facing away from the pinion 6, the lever 4 includes a cam 4*a* for actuating auxiliary contacts e.g. microswitches 12 as indicated in FIG. 1 and FIG. 3.

Figure 2:
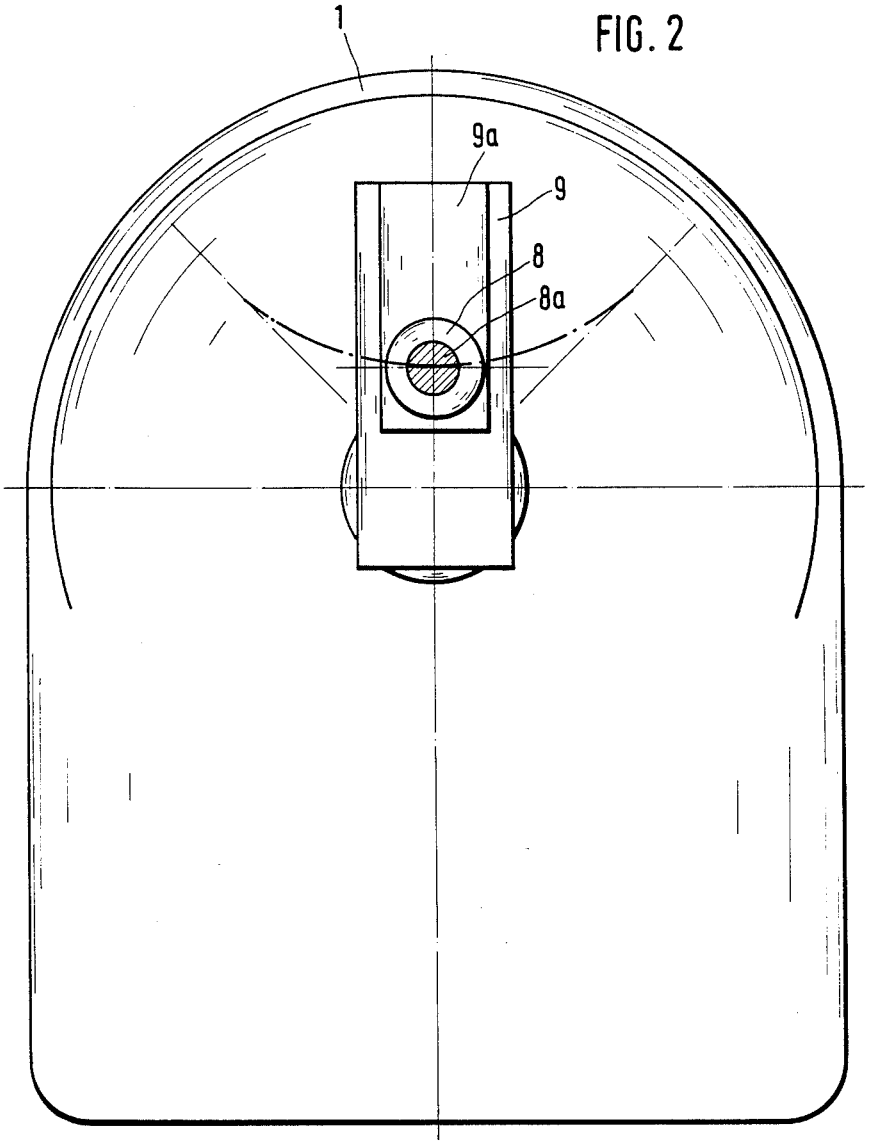
FIG. 2 is a partial view of the switch drive according to FIGS. 1 and 1*a* in accordance with arrow A in FIGS. 1 and 1*a;*

During operation, the input shaft 3 which is actuated by the magnet M drives the lever 4 so that the pinion 6 rolls along the internal toothing 7 thereby moving the engaging member 8 which in turn urges the switch arm 9 and thus the switch drive shaft 10 about the desired switching angle. In the embodiment as shown in FIG. 1, the switching angle is 90°, and it is apparent that the rotational angle of the lever 4 corresponds to the switching angle as carried out by the switching arm. As will be readily recognized from FIGS. 2 and 3, the engaging member 8 describes a hypocycloid relative to the circular arc as described by the switch drive 9 when being moved between its two end positions. The hypocycloid is shown in dash-dot line in FIG. 2.

At each end position, the cam 4*a* of the lever 4 will actuate the switch lever 12*a* of the respective one of the microswitches 12 as shown in broken lines in FIG. 3. In addition, FIG. 3 illustrates in broken lines the path of motion of the center of the engaging member 8 between its end positions.

Figures 1A, 1B:
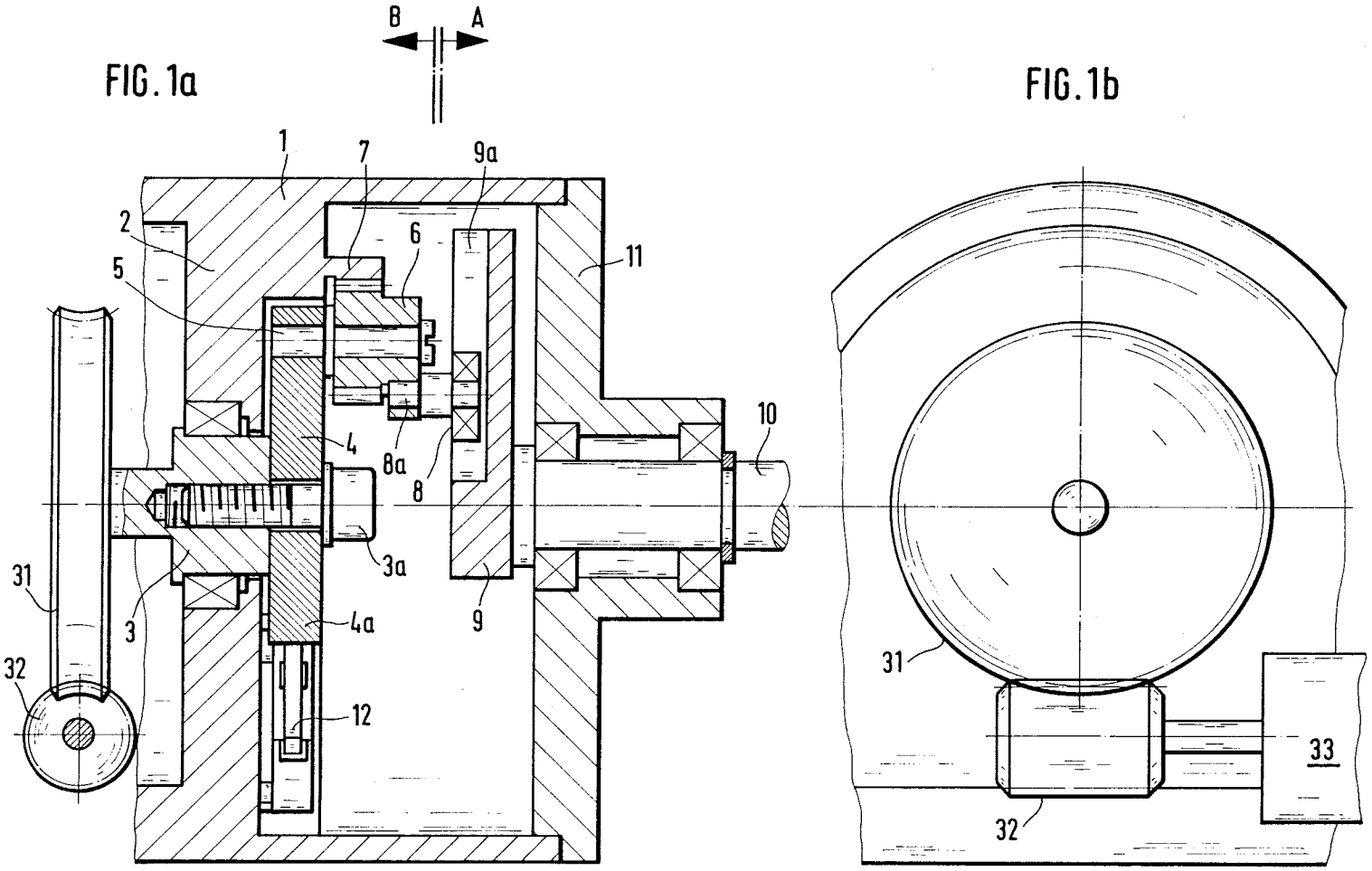
FIG. 1*a* is a schematically simplified longitudinal section of another embodiment of a switch drive according to the invention taken along the line I—I in FIG. 3.
FIG. 1*b* is a partial front view of the switch drive according to FIG. 1*a;*

Turning now to FIGS. 1*a* and 1*b*, there is shown a cross sectional view of another embodiment of a switch drive in accordance with the present invention, the difference from the previously described embodiment residing in the modified drive for the input shaft 3. As can be especially seen from FIG. 1*a*, the input shaft 3 is fixedly connected to a worm wheel 31 which meshes with a worm 32 driven by an electromotor 33. Such a drive results not only in a high switching torque but is especially suitable for switching angles other than 90° and/or for movement of the switch arm without reversal of the rotational direction which means that the switch arm describes a full circle over successive switching positions.

Figure 4:
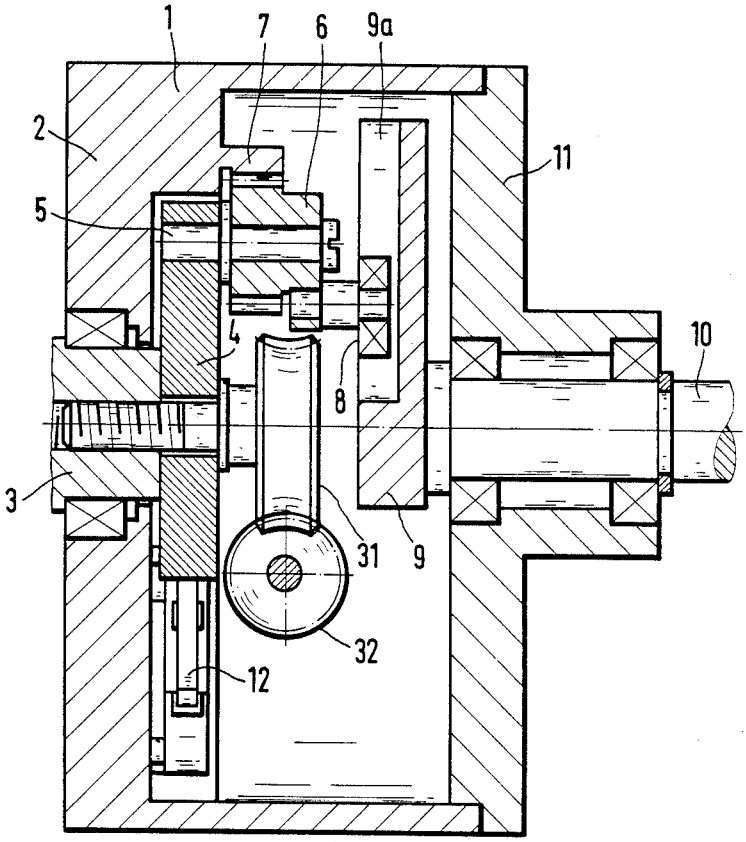
FIG. 4 is a longitudinal section of the switch drive of FIG. 1*a* in a modified arrangement.

As illustrated in FIG. 1*a*, the worm wheel 31 and worm 32 together with the drive motor are arranged outside the casing 1; however, it is certainly feasible to accommodate such a drive for the input shaft 3 also within the casing 1 so as to attain a very compact structure of the switch drive. An exemplified arrangement of the drive for the input shaft 3 within the casing 1 is shown in FIG. 4 which illustrates the worm wheel 31 and the worm 32 being located in the free space between the lever 4 and the switch arm 9.

While the invention has been illustrated and described as embodied in a Switch Drive for a Rotary Switch, it is not intended to be limited to the details shown since various modifications and structural changes may be made without departing in any way from the spirit of the present invention.

What is claimed as new and desired to be protected by Letters Patent is set forth in the appended claims:

We claim:

1. A switch drive for a rotary switch; comprising:
a casing provided with an internal toothing;
an input shaft supported in said casing;
a lever fixedly connected to said input shaft and supporting a pinion meshing with said internal toothing for transmitting rotation of said input shaft to said pinion;
a switch drive shaft;
transferring means for transmitting movement of said pinion onto said switch drive shaft, wherein said lever is movable between two end positions and is provided with at least one cam; and
contact means directly actuated by said cam in each of said end positions.

2. A switch drive as defined in claim 1 wherein said pinion includes a bearing bolt supported by said lever.

3. A switch drive as defined in claim 1 wherein said transferring means includes a switch arm connected to said switch drive shaft, an engaging member eccentrically supported by said pinion and slidably engaging said switch arm, said engaging member describing a hypocycloid thereby causing movement of said switch arm between said end positions along a circular arc.

4. A switch drive as defined in claim 1 wherein said internal toothing is coaxial to said input shaft.

5. A switch drive as defined in claim 1, and further comprising driving means for acting upon said input shaft, said driving means including a rotary magnet fixedly connected to said input shaft.

6. A switch drive as defined in claim 5 wherein said rotary magnet has a rotational angle of 90°.

7. A switch drive as defined in claim 1, and further comprising driving means for acting upon said input shaft, said driving means including a worm wheel fixedly connected to said input shaft, and an electromotively driven worm meshing with said worm wheel.

8. A switch drive as defined in claim 7 wherein said worm wheel and said worm are arranged within said casing between said lever and said transferring means.

* * * * *